United States Patent [19]

Matthews

[11] 4,393,799

[45] Jul. 19, 1983

[54] ATTACHMENT OF KNITTED FABRIC STRIP TO A PIECE OF FABRIC

[75] Inventor: Denis Matthews, Sutton-in-Ashfield, England

[73] Assignee: Mathbirk Limited, Sutton-in-Ashfield, England

[21] Appl. No.: 197,526

[22] Filed: Oct. 16, 1980

[30] Foreign Application Priority Data

Oct. 20, 1979 [GB] United Kingdom ..... 7936477
Jan. 25, 1980 [DE] Fed. Rep. of Germany ..... 8002667

[51] Int. Cl.[3] ..... D05B 1/00
[52] U.S. Cl. ..... 112/262.1; 112/27
[58] Field of Search ..... 112/25, 26, 27, 262.1

[56] References Cited

U.S. PATENT DOCUMENTS 3,023,720 3/1962 Underwood et al. ..... 112/25
3,527,181 9/1970 Beamon ..... 112/27
3,732,832 5/1973 Rosso ..... 112/25
4,128,066 12/1978 Peloggio ..... 112/27
4,174,670 11/1979 Birkhamshaw ..... 112/25

*Primary Examiner*—Ronald Feldbaum
*Attorney, Agent, or Firm*—Harding, Earley, Follmer & Frailey

[57] ABSTRACT

In the production of knitted garments especially pullovers, cardigans and sweaters it is frequently desired to add a knitted strip of material to the garment to define a neck opening. With this invention a first piece of fabric such as the strip is impaled on the points of a linking machine, the second piece of fabric such as the garment is then impaled on the points and the other marginal edge of the strip folded over the second piece of fabric and with said marginal edge abutting the points the two pieces of fabric are sewn together. When the strip has one marginal edge formed as a welt edge it is that edge which is impaled on the points.

9 Claims, 11 Drawing Figures

30
30a
12
7
80
6

7
30a
6
30

93
93a
12
100
101
101
81
18a

30'
6
12
80
13b
6'

ATTACHMENT OF KNITTED FABRIC STRIP TO A PIECE OF FABRIC

The present invention relates to attachment of a knitted fabric strip to a piece of fabric, in particular the attachment of a knitted fabric strip to a garment to form an edging, for instance an edging around a neck opening.

The knitted strip is knitted so that the wales extend transversely across the strip. Accordingly one longitudinal edge is a welt edge and the other longitudinal edge is a non-welt edge and is therefore liable to unrove. When using a linking machine to secure such a knitted fabric strip to another piece of fabric it has been common practice in the past to secure each stitch of the non-welt edge on a point of the dial so as to avoid unroving of the non-welt edge. This is a very skilled and time consuming operation.

It is a general object of the present invention to avoid the necessity of securing each stitch on a point and thereby remove the skill factor in using a linking machine to secure a knitted strip to a piece of fabric. It is also an object to attach in a neat manner a knitted fabric strip to the edge of a piece of fabric so as to create a neat edging.

According to one aspect of the present invention there is provided a method of linking a plurality of pieces of fabric together including impaling a first piece of fabric on the points of a linking machine and positioning a second piece of fabric so that an edge of the second piece of fabric is arranged so as to abut the points, and holding the second piece of fabric in position whilst securing the first and second pieces of fabric together by a sewing operation.

According to another aspect of the invention there is provided a method of attaching a knitted fabric strip to a piece of fabric, the knitted fabric strip having a longitudinal welt edge and a longitudinal non-welt edge, the method comprising running the knitted fabric strip onto the points of a linking machine so that the points penetrate the strip adjacent to the non-welt edge, pressing onto the points an edge of the piece of fabric and folding the strip so as to envelope the edge of the piece of fabric and securing the strip fabric to the piece of fabric by sewing, the sewing being carried out so that the sewn stitches are located adjacent to both longitudinal edges of the knitted strip and serve to secure the non-welt edges so as to prevent unroving.

Preferably after the strip has been run onto the points and before the piece of fabric is pressed onto the points, the non-welt edge is sewn to provide a seam of sewn stitches adjacent to the non-welt edge. Additionally, the fabric strip is preferably folded to envelope the piece of fabric so that the welt edge abuts the points, the piece of fabric enveloped by the strip is then presented to a sewing means for attaching the strip to the piece of fabric. Advantageously, the sewing means produces a seam of sewn stitches which overlaps said seam of stitches adjacent to the non-welt edge. The combination of both seams of stitches ensures that all free stitches of the non-welt edge are secured so as to prevent unroving.

According to another aspect of the present invention there is provided a method of attaching a knitted strip to a piece of fabric, the strip having a pair of longitudinal edges for attachment to the fabric, one longitudinal edge being a welt edge and the strip having a folded marginal edge portion the fold of which defines the other longitudinal edge, impaling the welt edge onto the points of a linking machine, pressing onto the points an edge of the piece of fabric and folding the strip so as to envelope the edge of the piece of fabric with said other longitudinal edge abutting the points, and presenting the piece of fabric enveloped by the folded strip to a sewing means whereat the strip is attached to the piece of fabric.

It is envisaged that the strip may include a knitted portion projecting laterally from the strip, so that when the strip is attached to the neck opening of a garment, the knitted portion forms a collar.

The above method is particularly suitable for attaching an edging strip to a piece of fabric wherein the edging strip is knitted so as to have one longitudinal selvedge edge and an opposite longitudinal edge which has a folded marginal edge portion, which portion is automatically formed during knitting of the strip. A long continuous edging strip may be formed by knitting a plurality of short strips on a rib machine separated by a draw thread. After removal of the draw thread the individual short strips are joined in an end to end fashion to form a long continuous strip. In a preferred construction of strip, initially a selvedge edge is knitted and then the main portion of the strip is knitted on both beds of the machine to give a strip of a desired width; the stitches on one bed are then transferred to the other bed and a plurality of courses are knitted to form the maringal edge portion, and preferably a thin yarn, such as cotton is used so that the fabric of the marginal edge portion is thinner than the main portion of the strip.

Finally, a draw thread is then knitted in before knitting of the selvedge edge of the next strip.

According to another aspect of the present invention there is provided a linking machine having a dial of points spaced about the circumference of the dial, guide means for guiding the strip, as defined above, to the points so that one of the longitudinal edges is positioned just below the points, and sewing means including fabric gripping means for holding fabric in position during the sewing operation.

According to another aspect of the present invention there is provided a linking machine for attaching a knitted fabric strip having a longitudinal welt edge and a longitudinal non-welt edge to a piece of fabric, the linking machine having a dial of points, a guide means for running the knitted fabric strip onto the points so that the points penetrate the strip adjacent to the non-welt edge, and preferably including a first sewing means for providing a seam of sewn stitches adjacent to the non-welt edge and a second sewing means for attaching the knitted fabric strip to the piece of fabric. Advantageously, the first and second sewing means are spaced apart as far as possible, the first sewing means also being spaced as near as possible, to the guide means.

According to another aspect of the invention there is provided gripping means for attachment to the sewing means of a linking machine the gripping means being constructed so as to grip fabric presented to the sewing means.

Reference to the accompanying drawings, in which.

Figure 1:
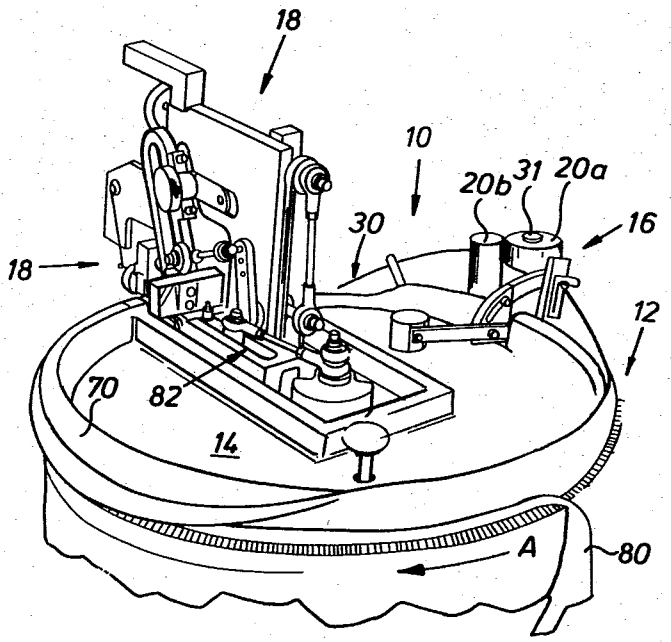
FIG. 1 is a part perspective view of a linking machine according to the present invention.

Referring initially to FIG. 1 there is shown a linking machine 10 having a dial of points 12 which is rotatably mounted with respect to a fixed central platform 14 having an upstanding flange 70 which extends about its periphery.

Circumferentially spaced about the platform 14 is a running-on or guide means 16 for feeding or running onto the points a fabric strip 30 and a sewing means 18; the dial 12 in use rotating in the direction of arrow A.

Figures 6, 7, 10, 11:
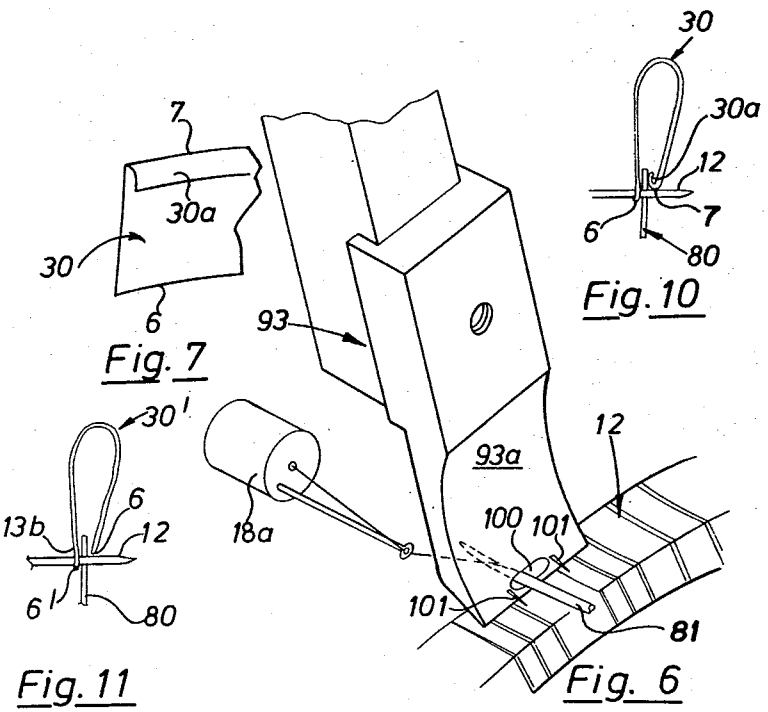
FIG. 6 is a detailed part perspective view of the fabric gripping means forming part of the sewing means shown in FIG. 2.
FIG. 7 is an end perspective view of a fabric strip.
FIG. 10 is a schematic illustration showing in cross-section the piece of fabric enveloped by the knitted fabric strip immediately prior to attachment of the strip to the piece of fabric according to one embodiment of this invention.
FIG. 11 is a schematic illustration showing in cross-section the piece of fabric enveloped by the knitted fabric strip immediately prior to attachment of the strip to the piece of fabric according to another embodiment of this invention.

The strip 30 as illustrated in FIG. 7 is knitted so as to have a lower longitudinal edge 6 defined by a welt edge and an upper longitudinal edge 7 which is formed by a fold line defined by a folded marginal portion 30*a*. The strip 30 is knitted so that the marginal portion 30*a* automatically folds to the position shown after removal from the knitting machine. For instance the strip 30 may be knitted on a rib machine in which both needle beds knit from edge 6 to edge 7 and then the stitches are transferred to one bed only and knitting is continued for several courses to produce the marginal portion 30*a*.

Figure 3:
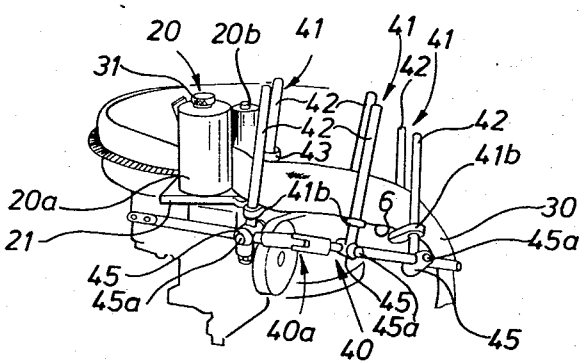
FIG. 3 is a more detailed perspective view of the running-on means shown in FIG. 1.
Figure 5:
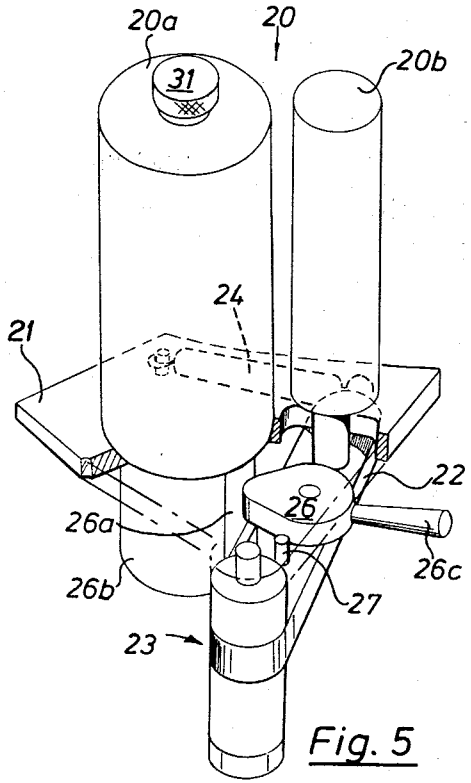
FIG. 5 is a more detailed part perspective view of a tensioning means which forms part of the running-on means shown in FIG. 3.

The running-on means 16 includes (FIG. 3) tensioning means in the form of a pair of nip rollers 20 mounted on a platform 21, one of the rollers 20*a* being rotatably driven whilst the other roller 20*b* is free running. Roller 20*b* is mounted on arm 22 (see FIG. 5) which is pivotally connected at one end to platform 21 via a pivot 23. A resilient spring 24 is attached to the other end of arm 22 so as to resiliently bias roller 20*b* into contact with roller 20*a*.

In order to separate the rollers to assist in setting up, a cam 26 (FIG. 5) is rotatably mounted on the arm 22 and is co-operable with a flat surface 26*a* formed on drive shaft housing 26*b*. A lever 26*c* is provided which enables the cam 26 to be rotated so as to deflect arm 22 to separate rollers 20*a*, 20*b*. On further rotation of the cam 26 it passes 'over centre' so as to also engage pin 27. In this position the cam is held in contact with pin 27 under the bias of spring 24 and thus the rollers 20*a*, 20*b* are held in a spaced apart condition.

Roller 20*a* is driven from the main drive shaft (not shown) of the linking machine so that its peripheral speed is slower than that of the dial. Thus a predetermined tension may be applied to the strip fabric 30 being fed onto the dial 12.

The tension applied by rollers 20*a*, 20*b* may be changed by either exchanging roller 20*a* for another of different diameter or by providing a variable speed drive for changing the speed of rotation of roller 20*a*. In order to achieve removal of roller 20*a*, a knurled nut 31 is provided which maintains roller 20*a* in driving contact with its drive shaft (not shown). Thus roller 20*a* may easily be removed by operating cam 26 to separate rollers 20*a*, 20*b* and then removing nut 31.

An articulated guide support arm 40 (FIG. 3) is provided which carries several guides 41 each comprising a pair of guide arms 42 spaced apart so that the strip fabric 30 passes therethrough in a flat condition. The lower edge 6 of the strip 30 rides across the base members 41*b* which extend between each pair of guide arms 42. The guide 41 nearest the rollers 20*a*, 20*b* is provided with an upper stop 43 which engages the upper edge 7 of the strip fabric 30. Each guide 41 is mounted on the support arm 40 via a boss 45 which is rotatable on the arm 40 and which may be locked in position by a bolt 45*a*.

The articulated support arm 40 has a joint 40*a* which is releasibly lockable. Accordingly the position and angular orientation of the guides 41 is adjustable and these are arranged so that the lower edge of the fabric strip 30 runs across the surface of the platform 21 into the nip between rollers 20*a*, 20*b*.

The platform 21 is positioned so that its upper surface is slightly below the dial of points 12 and therefore accurately determines the position of the lower edge 6 in relation to the points.

Figure 4:
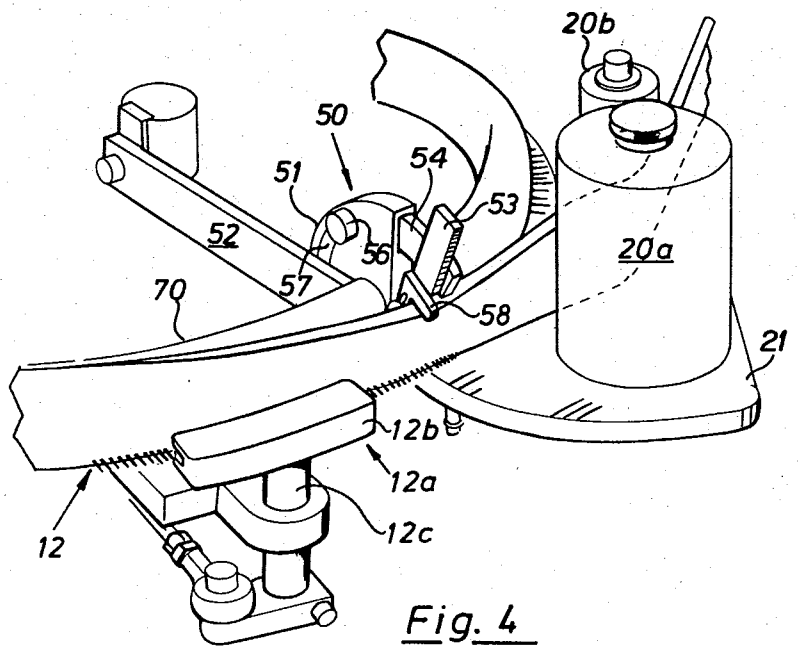
FIG. 4 is a more detailed perspective view of a run-on guide which forms part of the running-on means shown in FIG. 3.

An adjustable guide 50 (FIG. 4) is positioned between the rollers 20*a*, 20*b* and the dial of points 12 and serves to incline the strip 30 away from the dial of points 12 so that penetration of the points is performed at an oblique angle. This ensures that penetration of the points occurs near to the edge 6 of the fabric strip 30.

Guide 50 comprises a quadrant support 51 carried by arm 52 secured to the frame of the machine. Guide arm 53 is supported by a curved arm 54 slidably received in a curved channel (not shown) formed in the quadrant support 51. The curved arm 54 carries a threaded bolt 56 which projects through a slot 57 formed in the quadrant support 51 and enables the arm 54 to be held in a desired position. Movement of arm 54 relative to quadrant 51 alters the inclination of guide arm 53. The guide arm 53 slidably carries a stop 58 which engages the upper edge of the fabric strip 30 and ensures that the lower edge 6 is maintained at its predetermined height prior to being impaled onto the points.

The strip 30 when impaled on the tip of the points is forced down the shafts of the points by pusher means 12*a* and the strip eventually abuts against the flange 70 and is maintained in a vertical position thereby. The pusher means 12*a* includes a shoe 12*b* which is mounted on a shaft 12*c*. The shaft 12*c* is oscillated in order to cause oscillatory deflection of the shoe 12*b* for pushing the fabric onto the points.

At a convenient location between the sewing means 18 and the running-on means 16 an edge of the second piece of fabric 80 is impaled onto the points manually by an operative. The operative then folds over the fabric strip 30 to envelope the edge of the fabric 80 with marginal portion 30*a* residing on the inside of the fold. The strip 30 is folded so that its upper edge 7 abuts the shafts of the points. The strip remains folded due to the tension within the strip (FIG. 10).

The folded strip 30 enveloping fabric 80 is then presented to the sewing means 18 whereat the two pieces of fabric are sewn together.

Figure 2:
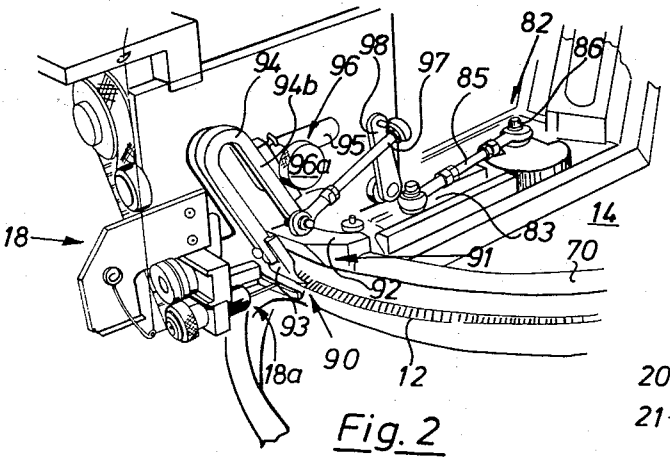
FIG. 2 is a more detailed part perspective view of the sewing means shown in FIG. 1.

The sewing means 18 (FIG. 6) includes a needle 81 which is reciprocated radially of the dial of points 12 by drive means 82 (FIG. 2) to co-operate with a looper 18*a*. The drive means 82 includes a slide 83 in which the needle 81 is mounted, the slide 83 being reciprocated by a push rod 85 mounted at one end on an eccentric 86. The needle is located slightly above the points in order to penetrate all layers of fabric. The sewing means 18 also includes a gripping means 90 which serve to intermittently grip fabric presented to the sewing means 18. The gripping means 90 includes a stationary gripper jaw 91 in the form of a guide member 92 which serves to incline the fabric strip 30 so that the needle 81 penetrates the fabric obliquely and thereby ensuring the needle penetrates as close as possible to edge 7 of the fabric strip 30.

The gripper means 90 also includes a movable gripper jaw 93 which is movable radially of the dial of points 12. The jaw 93 is mounted on one arm of a U-shaped support 94, the other arm 94*b* being pivotally attached to frame member 95 via a pivotal connection 96. A push rod 97 is attached to a lever 98 and is reciprocally driven thereby in order to cause reciprocal deflection of support 94 about pivotal connection 96 and so cause gripper jaw 93 to move toward and away from gripper jaw 91. The pivotal connection 96 includes a threaded shaft haing a knurled head 96*a*, the shaft being threadedly received in frame member 95. The arm 94*b* is biased by means of a spring (not shown) into contact with head 96*a* so that rotating of head 96*a* displaces the support 94 circumferentially of the dial 12. The gripper jaw 93 is provided with a slot 100 (FIG. 6) through which the needle 81 passes. Located on either side of slot 100 is a sharp projection 101 so that when fabric is trapped between jaws 91 and 93 it is positively gripped and held in position. The jaw 93 has a dished surface 93*a* so that the point of engagement with the fabric is as near to edge 7 as possible and so that, when the jaws 91 and 93 are in a gripping position, there is sufficient clearance above the slot 100 to accommodate the bulkiness of the fabrics.

The movement of the movable gripper jaw 93 is synchronized with the movement of the needle 81 so that the gripper jaw 93 is in its gripping position during advancement and penetration of the needle 81 and so that the gripper jaw 93 moves to its fully retracted position whilst the needle 81 withdraws from the points. Consequently the gripper jaw 93 is spaced from the fabric during indexing of the dial of points 12.

After sewing the two pieces of fabric together, the impaled pieces of fabric are removed from the points by a plough member (not shown) which urges the fabric off the points as the dial is indexed.

The above apparatus may also be used to join a strip 30' FIG. 11 of knitted fabric having longitudinal edges defined respectively by a welt edge 6 and a non-welt edge 6'. In this respect the strip 30' is fed through the running-on means so that its lower longitudinal non-welt edge 6' is run onto the points 12 of the linking machine. In order to prevent unroving, the sewing means 18 is arranged to produce a sufficient number of stitches per inch in order to secure all free loops of the non-welt edge 6' so as to prevent unroving.

Figure 8:
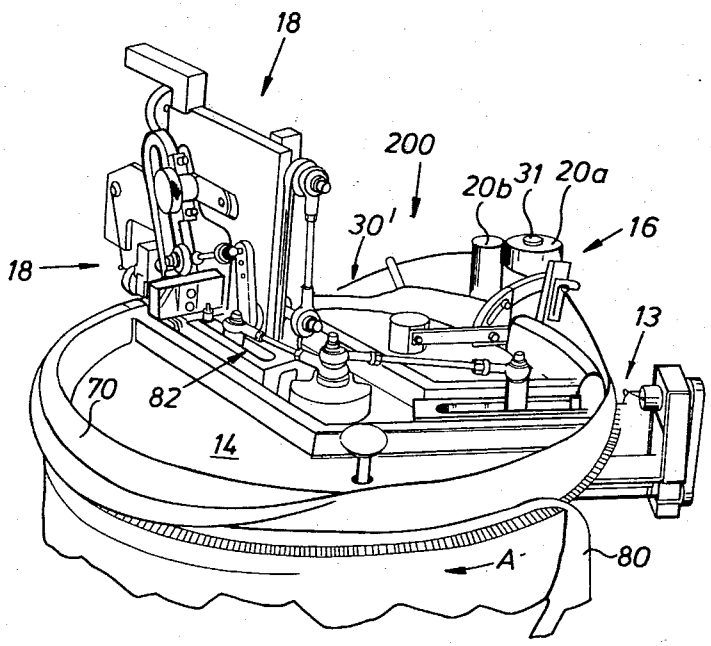
FIG. 8 is a view similar to FIG. 1 showing another embodiment according to the present invention.
Figure 9:
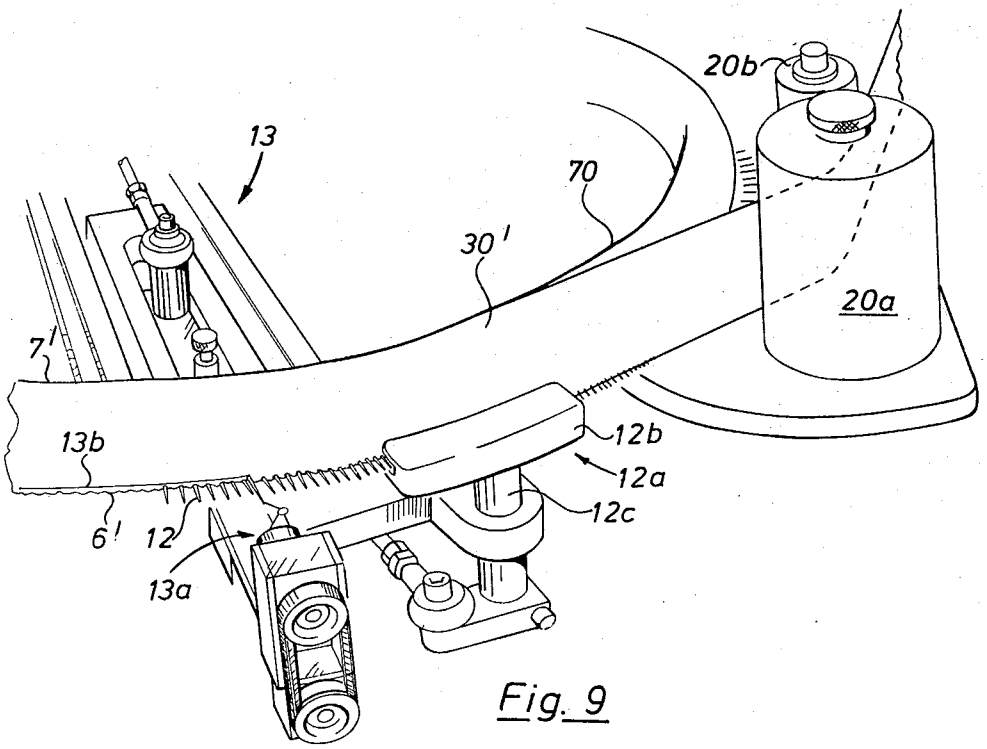
FIG. 9 is a more detailed perspective view of a first sewing means shown in FIG. 8.

Preferably, securance of strip 30' to a piece of fabric 80 is achieved using a linking machine as illustrated in FIGS. 8 and 9.

The linking machine 200 illustrated in FIGS. 8 and 9 includes similar features to that described in relation to FIGS. 1 to 6 and accordingly the same reference numbers have been adopted to designate these features.

The machine 200 includes an additional sewing means 13 which is spaced circumferentially of the dial from sewing means 18. The dial rotates in a direction of arrow A and so the sewing means 13 and 18 are respectively referred to as first and second sewing means.

The first sewing means 13 of conventional construction, is positioned next to the pusher means 12*a* as shown in FIG. 9 and co-operates a looper 13*a* to create a seam of sewn stitches 13*b* (FIG. 11) adjacent to lower edge 6' of the knitted strip 30'.

At a convenient circumferential location between the first and second sewing means 13, 18 an edge of the second piece of fabric 80 is impaled onto the points. The fabric strip 30' is then folded to envelope the edge of fabric 80 so that the welt edge 6 abuts the shafts of the points as shown in FIG. 11. The strip 30' remains folded due to the tension within the strip.

The folded strip 30' enveloping fabric 80 is then presented to the second sewing means 18 whereat the two pieces of fabric are sewn together. Preferably, the seam produced by the second sewing means overlaps the seam 13*b* so that visually there appears to be only one seam. The production of the two seams of sewn stitches is also arranged so as to ensure that all the free switches of the non-welt edge 6' are secured thereby preventing unroving.

I claim:

1. A method of linking a fabric strip to a piece of fabric, the fabric strip having spaced longitudinal edges, comprising impaling the piece of fabric on the points of a linking machine and positioning the fabric strip on the points of the linking machine adjacent one of the longitudinal edges of the strip in a manner whereby the second longitudinal edge of the strip is arranged to abut the points, gripping the fabrics by gripping means to position them relative to each other preparatory to linking and then linking the two fabrics together by a sewing operation.

2. A method of attaching a knitted fabric strip to a piece of fabric, the knitted fabric strip having spaced longitudinal edges for attachment to the piece of fabric, one longitudinal edge being a welt edge, and the strip of knitted fabric having a folded marginal edge portion, the fold of which defines the other longitudinal edge, comprising impaling the knitted fabric strip along its welt edge onto the points of a linking machine, pressing onto the points the piece of fabric along an edge thereof, folding the knitted fabric strip intermediate its longitudinal edges so as to envelope the said edge of the piece of fabric with said other longitudinal edge of the strip abutting the points and then presenting the piece of fabric, with its said edge enveloped by the folded knitted fabric strip, to a sewing means whereat the strip is attached to the piece of fabric.

3. A method of attaching a knitted fabric strip to a piece of fabric, the knitted fabric strip having spaced longitudinal edges, one longitudinal edge being a welt edge and the other longitudinal edge being a non-welt edge, comprising running the knitted fabric strip onto the points of a linking machine so that the points penetrate the strip adjacent to its non-welt longitudinal edge, pressing onto the points the piece of fabric adjacent an edge thereof, folding the knitted fabric strip intermediate its longitudinal edges so as to envelope the said edge of the piece of fabric with said longitudinal welt edge of the strip abutting the points and then securing the knitted fabric strip to the piece of fabric by sewing, the sewing being carried out so that the sewn stitches are located adjacent to both longitudinal edges of the knitted fabric strip and serve to secure the non-welt longitudinal edge so as to prevent the unroving thereof.

4. A linking machine having a dial of points and a sewing means characterized by fabric gripping means for holding fabric in position relative to the points during sewing, said gripping means including a pair of jaws which grip fabric therebetween during sewing, one of said jaws being stationary and the other of said jaws being moveable relative to the stationary jaw in a radial direction relative to said dial.

5. A linking machine according to claim 4 wherein the movable jaw is provided with gripping formations for positively gripping the fabric when fabric is gripped between said jaws.

6. A linking machine according to claim 5 wherein the movable jaw includes an aperture through which the needle of the sewing means can pass during sewing, the gripping formations being positioned either side of the aperture in a circumferential direction of the dial.

7. A linking machine according to claims 4, 5, or 6 including a guide means for running a strip of fabric onto the points so that the strip is impaled on the points of the dial adjacent to one of the longitudinal edges of the strip, the guide means also serving to tension the strip on the points.

8. A linking machine according to claim 7 further including a flange extending about the inner circumference of the dial between the guide means and the sewing means, the flange extending upwardly from said points to provide a support surface against which the strip is support during its movement between the guide means and the sewing means.

9. A linking machine according to claim 7 further including an additional sewing means located between the guide means and said sewing means.

* * * * *

UNITED STATES PATENT AND TRADEMARK OFFICE

CERTIFICATE OF CORRECTION

PATENT NO. : 4,393,799

DATED : July 19, 1983

INVENTOR(S) : Denis Matthews

It is certified that error appears in the above-identified patent and that said Letters Patent are hereby corrected as shown below:

Title Page

Line [30], delete "[DE] Fed. Rep. of Germany" and substitute --[GB] United Kingdom--

Signed and Sealed this

*Twentieth* Day of *September 1983*

[SEAL]

*Attest:*

GERALD J. MOSSINGHOFF

*Attesting Officer*

*Commissioner of Patents and Trademarks*